US005958180A

United States Patent [19]

Hubbe et al.

[11] Patent Number: 5,958,180

[45] Date of Patent: Sep. 28, 1999

[54] METHOD FOR INCREASING THE STRENGTH OF A PAPER OR PAPERBOARD PRODUCT

[75] Inventors: Martin A. Hubbe, Campbell Hall; Dinkar G. Wagle, Monroe, both of N.Y.; Erwin R. Ruckel, Wilton, Conn.

[73] Assignee: International Paper Company, Purchase, N.Y.

[21] Appl. No.: 08/935,387

[22] Filed: Sep. 23, 1997

[51] Int. Cl.[6] ..... D21C 9/00

[52] U.S. Cl. ..... 162/9; 162/157.6; 162/72; 162/100; 8/115.57; 8/115.51; 8/115.56

[58] Field of Search ..... 162/9, 157.6, 72, 162/158, 182, 183, 100, 179; 8/115.54, 115.56, 115.62, 115.64, 116.1, 115.51, 129, 115.57

[56] References Cited

U.S. PATENT DOCUMENTS

| | | | |
|---|---|---|---|
| 3,051,543 | 8/1962 | Skogseid | 162/157.6 X |
| 3,445,330 | 5/1969 | Kulick et al. | 162/164.6 |
| 3,511,874 | 5/1970 | Allan | 260/473.5 |
| 4,035,229 | 7/1977 | Rave | 162/164 EP |
| 4,036,682 | 7/1977 | Chan et al. | 162/167 |
| 4,061,612 | 12/1977 | Bertozzi et al. | 260/31.4 R |
| 4,088,530 | 5/1978 | Chan et al. | 162/168 NA |
| 4,156,628 | 5/1979 | Rave | 162/157 R |
| 4,162,188 | 7/1979 | Nakamura et al. | 162/76 |
| 5,137,537 | 8/1992 | Herron et al. | 8/120 |
| 5,384,012 | 1/1995 | Hazard, Jr. | 162/9 |
| 5,427,587 | 6/1995 | Arkens et al. | 8/116.1 |
| 5,441,602 | 8/1995 | Harris et al. | 162/48 |
| 5,520,777 | 5/1996 | Shisko | 162/13 |
| 5,718,728 | 2/1998 | Arkens et al. | 8/116.1 |

OTHER PUBLICATIONS

An Investigation of Low Degree of Substitution Carboxymethycelluloses, Jerrold A. Walecka, *Tappi,* Jul., 1956, vol. 39, No. 7, pp. 458–463.

Wet End Starch: Adsorption of Starch on Cellulosic Fibers, J. Marton and T. Marton, *Tappi,* Dec., 1976, vol. 59, No. 12, pp. 121–124.

An Overview of Cellulose–Reactive Sizes, David H. Dumas, *Tappi*, Jan., 1981, vol. 64, No. 1, pp. 43–46.

Polyelectrolytes Adsorbed on the Surface of Cellulosic Materials, L. Winter, L. Wagberg, L. Odberg and T. Lindstrom, *Svenska Traforskningsinstitutet,* Aug. 12, 1985, 23 pages.

"The Reactivity of Alkenyl Succinic Anhydride: Its Pertinence With Respect to Alkaline Sizing," R. B. Wasser, *Journal of Pulp and Paper Science,* vol. 13, No. 1, Jan. 1987, pp. J29–J32.

Some Fundamental Chemical Aspects on Paper Forming, Tom Linstrom, *Transactions of the Ninth Fundamental Research Symposium Held at Cambridge: Sep. 1989,* pp. 311, 317–320 and 384.

"The Chemistry of Papermaking," J.C. Roberts and J. Tatham, PIRA Conference, Jan. 28–29, 1992, 27 pages.

The Effects of Temperature, pH and Alkalinity on ASA Sizing in Alkaline Papermaking, R. M. Savolainen, *Tappi Proceedings,*1996 Papermakers Conference, pp. 289–295.

"Acid Group Topochemistry and Fibre–to–Fibre Specific Bond Strength", D. Barzyk et al., *Journal of Pulp and Paper Science,* vol. 23, No. 2, Feb. 1997, pp. J59–J61.

"The Determination of Fibre Charge and Acidic Groups of Radiata Pine Pulps", J.A. Floyd et al., *Nordic Pulp and Paper Research Journal,* No. 1, 1993, pp. 48–52 and 67.

*Primary Examiner*—Stanley S. Silverman
*Assistant Examiner*—José A. Fortuna
*Attorney, Agent, or Firm*—Luedeka, Neely & Graham P.C.

[57] ABSTRACT

Processes for increasing the strength of cellulosic fibers are carried out by contacting relatively dry cellulosic fibers with an agent in particulate or vapor form comprising a carboxylic acid cyclic anhydride at an elevated temperature for a time sufficient to significantly increase the bonding strength of the fibers. The treated fibers bond more readily to one another and they also hold wet and dry strength aids more strongly. Furthermore, the treatment does not significantly affect the internal chemical structure of the fibers so that paper made from the fibers exhibits overall improved dimensional stability.

23 Claims, 6 Drawing Sheets

METHOD FOR INCREASING THE STRENGTH OF A PAPER OR PAPERBOARD PRODUCT

FIELD OF THE INVENTION

The invention relates to a method for increasing the strength of a paper or paperboard product and to a paper or paperboard product having increased strength.

BACKGROUND OF THE INVENTION

Paper and paperboard products (referred to hereinafter as "paper" for purposes of simplicity) made from cellulosic materials owe their strength, in part, to inter-fiber hydrogen bonds which form when water is drained from an aqueous slurry of fibers on a paper machine producing a web of fibers which is then pressed and is dried. Because the hydrogen bonds between fibers are relatively weak, the bonds are easily broken by the addition of water to paper which makes paper ideally suited for recycle.

Unfortunately, paper made using cellulosic fibers obtained from recycle or waste paper sources does not exhibit the same degree of strength as paper made from virgin pulp. Each time wood fibers are recycled, some of the bonding strength inherent in the fibers is lost. Loss in bonding strength may be due to structural damage to the fibers caused by repeated refining or other mechanical stress and/or due to a change in crystal structure of the cellulose in the fibers as a result of treatment with various agents and/or heating the pulp or paper. The change in crystal structure of the fibers is evidenced by the decreased ability of recycled fibers to swell.

Cellulosic fibers made directly from wood sources may also exhibit relatively weak strength properties due to the paper manufacturing methods or properties of the pulp. In order to increase the bonding strength of cellulosic fibers, particularly recycled cellulosic fibers, dry strength agents such as cationic starches have been added to the fibers. However, there is a pronounced decrease in retention of many dry strength agents on the fibers during paper formation when more than about 1 wt.% of the agent is applied, which limits the level of improvement achievable using such additives.

Cellulosic fibers have been chemically modified by treatment with alphachloroacetic acid or succinic anhydride dissolved in a solvent in an attempt to increase the bonding of cationic dry strength agents to the fibers so that more is retained in the web forming on the machine. However, chemical modification by such techniques tends to reduce the dimensional stability of the fibers. Because of the loss of dimensional stability, the fibers exhibit greater swellability resulting in paper products which change their dimensions more dramatically with changes in moisture and/or temperature.

It is therefore an object of the invention to provide a method for upgrading the quality of paper containing secondary fibers.

Another object of the invention is to provide a method for increasing the strength of paper products.

Still another object of the invention is to increase the interchain hydrogen bonding characteristics of cellulosic fibers formed into a paper web from wood pulp without adversely affecting the swellability of the fibers.

Another object of the invention is to provide high strength paper products made from recycled cellulosic fibers.

Yet another object of the invention is to provide a method for producing high strength pulp for paper products which is substantially independent of the source of the pulp fibers.

Still another object of the invention is to provide a method for increasing the ability of cellulosic fibers to bond to dry strength agents or wet strength agents.

SUMMARY OF THE INVENTION

With regard to the foregoing and other objects and advantages, the present invention provides a method for increasing the bonding strength of cellulosic fibers. The method comprises contacting an agent, in particulate or vapor form, comprising a carboxylic acid cyclic anhydride with relatively dry cellulosic fibers and heating the fibers and agent in contact therewith at a temperature and for a time sufficient to substantially increase the potential of the fibers to form strong interfiber bonds when the fibers are later used for making paper or paperboard products.

In another aspect, the invention provides a method for increasing the strength of a paper or paperboard web containing cellulosic fibers which comprises applying to the fibers of a web having a moisture content below about 20 % by weight an agent,in particulate or vapor form, comprising a carboxylic acid cyclic anhydride and thereafter heating the web at a temperature and for a time sufficient to substantially increase the bonding strength of the web fibers.

In accordance with yet another aspect of the invention, a method is provided for treating cellulosic fibers which comprises contacting relatively dry cellulosic fibers with particulate maleic anhydride and heating the fibers at a temperature sufficient to significantly increase the carboxyl content of the fibers without significantly embrittling the fibers. The fibers may be in the form of pulp or they may be fully or partly consolidated in a web or sheet.

BRIEF DESCRIPTION OF THE DRAWINGS

The above and other aspects and advantages of the invention will now be further described in conjunction with the accompanying drawings in which.

DETAILED DESCRIPTION OF THE INVENTION

Figure 1:
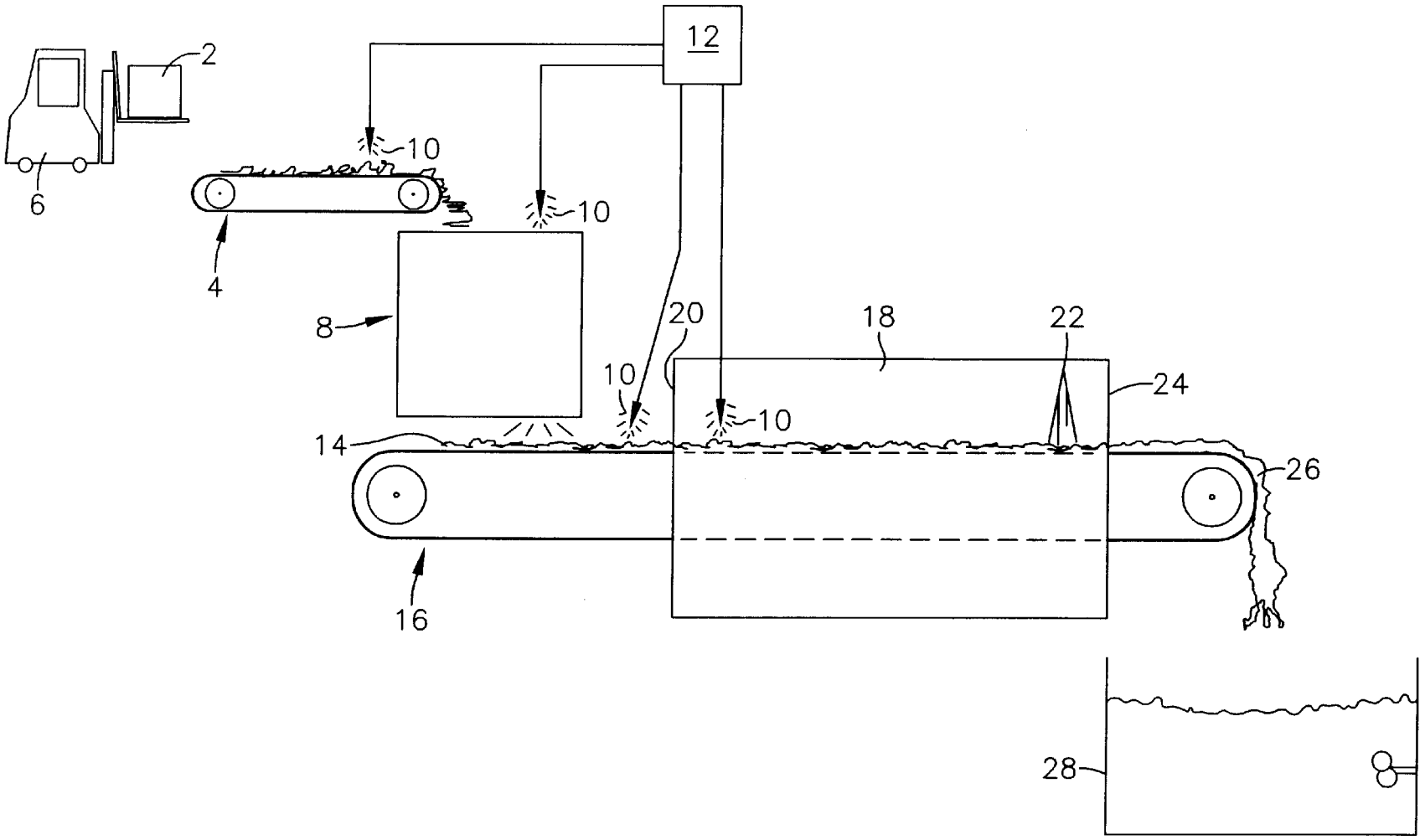
FIG. 1 is a schematic diagram of a method for increasing the bonding strength of pulp in a secondary fiber pulping process.

The invention provides a method for increasing the bonding strength of cellulosic fibers, especially fibers from recycled paper, above the strength which may be obtained by internal chemical modification or cross-linking of the cellulose in the fibers and without the drawbacks associated with prior methods. According to the method, relatively dry wood pulp fibers are treated with an agent in particulate form comprising a carboxylic acid cyclic anhydride and heat is applied to the treated fibers or web to effect a reaction between the agent and the fibers or web. The wood pulp fibers to be treated may be loose or unconsolidated or they may be incorporated in a web of cellulosic fibers. By "relatively dry" it is meant that the fibers or a web containing the fibers do not contain sufficient moisture to permit significant hydrolysis of the agent applied to the fibers prior to application of sufficient heat to effect a reaction between the agent and the fibers. Typically, a moisture content below about 20% by weight water will be sufficient to limit hydrolysis of the agent before it is able to react with the fiber surface.

While not desiring to be bound by theoretical considerations, it is believed that increasing the carboxyl content of the cellulosic fibers by surface modification of the fibers rather than by cross-linking the cellulose internal to the fibers results in a significant improvement in the bonding ability of the fibers and an increase in the ability of the fibers to adsorb and/or interact positively with dry-strength or wet strength agents. Accordingly, more dry and wet strength additives which have a net cationic charge may be retained in the pulp than with fibers which have not been treated according to the process of the invention, resulting in even greater strengthening effects.

Cellulosic fibers used in the methods and products of the invention may be obtained from a number of sources. Virgin pulp is provided from wood chips which are converted to fibers by cooking according to well-known processes and dispersed in water to make pulp which becomes the furnish for papermaking. Virgin pulp includes wet-lap pulp, fluff-pulp and bale pulp. Wet-lap pulp is made by draining and squeezing water from a fiber slurry without using heat to dry the pulp. Both fluff-pulp and bale pulp are dried in the presence of heat from sources such as hot air, infra-red heating devices and hot metal surfaces on drier cans. Regardless of the source of the pulp, the pulp may be used in its bleached or unbleached form to make a paper or paperboard product having increased bonding strength.

The pulp may also be obtained from recycle paper sources. Because the pulp from recycle sources has been previously refined, treated and heated, the bonding strength of fibers in such pulp is generally less than in virgin pulp.

Recycle pulp is typically received in the form of bales or loose sheets. The moisture content of the pulp is usually in the range of from about 4 to about 20 percent based on the oven dry weight of solids in the pulp. The pulp may be treated in accordance with the invention as received, but it is preferred that the pulp be shredded and/or hammer milled before treatment by the methods according to the invention in order to increase the surface area of the pulp accessible to the powdered reagent or its vapors.

Virgin pulp and recycle pulp may be used alone or mixed together to provide a variety of paper products so as to meet certain property, economic or business objectives. Regardless of the source of the pulp and how it has been prepared, methods conducted according to the invention generally provide significant improvement in the bonding strength potential of the fibers, especially with regard to retention of dry and wet-strength agents. The method is particularly applicable to cellulosic pulp or a cellulosic fiber web which is heated to dryness on a papermaking machine after treating the pulp or web with the agent.

In the treatment process according to the invention, virgin pulp, recycle pulp, a mixture of virgin and recycle pulp or a web made from virgin pulp, recycle pulp or a mixture of virgin and recycle pulp is treated with the agent in particulate form such as a dry powder, as a molten liquid which is sprayed onto the fibers or web, as a vapor associated with heating particulates or droplets of the agent within the fiber mixture or before addition of the agent to the fiber mixture, or as a dissolved component of a non-hydrolyzing volatile solvent solution. The solvent is evaporated prior to or during the heating step leaving the agent in contact with the fibers. While not preferred, the agent may also be applied to the pulp or web directly as a vapor. Regardless of the method used to treat the pulp and/or web with the agent, an important aspect of the invention is that the agent be delivered to the relatively dry pulp or web in a dry and/or substantially unhydrolyzed form. The agent may also be applied to the pulp and/or web by dispersing the agent in a substantially non-hydrolyzing medium.

Preferably, the agent used to treat the pulp or web comprises a cyclic anhydride of the type obtained when water is removed from a di-functional or multi-functional carboxylic acid. A preferred cyclic anhydride is a dicarboxylic acid anhydride having a melting point below about 150° C. and a vapor pressure within the range of from about 2 Torrs to about 170 Torrs, including all ranges subsumed therein. Of the foregoing, the agent is more preferably maleic anhydride, phthalic anhydride, succinic anhydride and mixtures of two or more of these compounds, and is most preferably maleic anhydride.

The agent may be mixed with relatively dry pulp or applied to a relatively dry web as a powder, spray or vapor. Preferably, the moisture content of the pulp or web is less than about 20 percent based on the dry weight of the fibers or web. Accordingly, it is preferred that a significant amount of water be removed from the pulp or web or that relatively little or no water be added to an already dry pulp or web before treatment, thereby reducing the tendency of the agent to react with water rather than the hydroxyl groups present at the surfaces of the fibers.

It is also preferred that the agent be applied to the pulp or web in particulate form in the absence of a solvent or carrier fluid which will hydrolyze the agent to any significant extent before it is able to interact with the fiber surface. As a particulate, the agent may be applied to the fibers or fibrous web by techniques well known to those of ordinary skill.

Equipment which may be used to apply the powder, molten liquid, or vaporized agent to the fibers or web includes conventional grinding and pulverizing equipment such as hammer mills, impactors, rolling-compression mills, attrition mills, tumbling mills, fluid-energy mills, or agitated mills. The process may use direct or indirect heating with transport of individualized fibers, shredded paper, or sheet materials through the heated zone within a pipe by means of a conveyor belt, screw, or pneumatic conveyor.

In a preferred embodiment, solid maleic anhydride is introduced in chunk or pellet form into the hopper of a pendulum mill, a type of roller mill commercially available from Bradley Pulverizer Company of Allentown, Pa.. The roller mill reduces the particle size of the maleic anhydride to below 75 $\mu$m diameter and feeds the ground particles by gravity into a screw conveyor. Bales of virgin or secondary fiber are separately fed into the hopper of a shredder, yielding a loose, porous collection of paper strips. Powdered agent is conveyed with the fiber by means of a high-amplitude screw conveyor which provides substantially homogenous mixing of the components in the screw conduit with minimum physical damage to the fibers.

It is preferred that the initial mixing of fiber and agent take place under ambient temperature conditions and that the contents of the conduit be conveyed through a preheating zone and then through a curing zone having a temperature controlled in the range of from about 80° to about 110° C. The temperature of the curing zone may be controlled by adjusting the amount of low-pressure steam within a jacketed preheater zone of the conduit reactor. The length of the curing zone section of the conduit is selected to provide a suitable curing time at a desired production rate of treated fibers. For example, for a production rate of 10 pounds per day treated fiber having a fiber packing density of 6 pounds per square foot, and using a pipe reactor having an effective diameter of 18 inches, a reaction zone 13 feet in length will provide a curing time of approximately ten minutes.

The curing zone is preferably followed by a quenching zone in which the maleic anhydride treated fiber is cooled by a spray of water or mildly alkaline solution which serves to quench any unreacted anhydride and convert the anhydride to acid or acid-salt byproducts. The reactor is designed such that excess water will tend to flow by gravity toward an exit end of the reactor. Accordingly, the entire reactor may be inclined downwards toward the exit end thereof.

The agent is most preferably provided in finely divided powder form having a mesh size of from about 20 to about 200 mesh. Preferably, the agent is applied in an amount sufficient to provide from about 0.01 to about 10 percent by weight agent based on the oven-dried weight of the pulp, and most preferably from about 0.01 to about 2.0 percent by weight.

It is preferred to treat pulp with the agent before the dry fibers are wetted and before any significant heat is applied to the fibers. Dry fibers are preferably obtained from bales of recycled paper. Accordingly, the agent may be added to relatively dry pulp in a shredding, fluffing or hammer-milling operation. In the alternative, the agent may be added to a relatively dry web of fibers after the wet end of a paper machine after the moisture content of the pulp has been reduced to less than about 20% by weight, to relatively dry pulp after the wet end of a dry-lap pulp forming machine, to a relatively dry web of paper or paperboard or to a relatively dry pulp in a flash-drying process.

After applying the agent to the pulp, the mixture of fiber and pulp is heated to a temperature and for a time sufficient to bring about a reaction between the agent and the pulp. Generally, the temperature may range from about 50° to about 120° C. At lower temperatures, the heating time used may be longer than at higher temperatures. However, relatively long heating times and temperatures higher than about 120° C. should be avoided as they may cause embrittlement of the fibers due to internal cross-linking of the cellulose within the fibers. Accordingly, heating times may range from about 5 minutes to about 15 minutes at temperatures ranging from about 50° and about 100° C. and from about 1 to about 5 minutes at temperatures ranging from about 110° to about 120° C. It is preferred to rinse the pulp after the treatment with water having a pH above about 4 in order to convert any residual anhydride to its acid or salt form.

Various dry and wet strength agents may be used in conjunction with the agent to further increase the strength of paper made from the treated pulp. These include, but are not limited to, cationic starch, copolymers or acrylamide, polyamide resins, polyamidoamine-epichlorohydrin resins, cationic guar products and mixtures of like materials with anionic polymers. A particularly preferred agent is a cationic starch solution. The amount of dry-strength or wet-strength agent used may range from 0 to about 40 pounds per ton of dry paper product, or more preferably from about 2 to about 10 pounds per ton of dry paper product. It has been found that pulp treated according to the process of the invention exhibits a surprising increase in the retention of wet- or dry-strength agents as compared to pulp not treated with the agent according to the methods of the invention.

Suitable retention aid polymers, microparticles and other chemical additives conventionally used for preparing paper products may also be used to increase the efficiency of retention of the agent on the mat of fibers during the paper web forming process. For example, calcium carbonate or other buffers may be mixed with the agent to promote its reactivity during the heating step of the process. Likewise, the agent may be diluted with a filler material such as clay, talc, starch or cellulose to help disperse the agent throughout the fibers to be treated.

The agent may be mixed with dry pulp in shredded or fluffed form in hammer mill or shredder or on a conveyor belt passing through a heated zone prior to slurrying the pulp. After the heated zone, a water shower may be used to hydrolyze any unreacted agent. Cellulosic fibers and the agent may also be combined and mixed in a fluidized bed or the fibers may be treated with the agent during drying of the fluff pulp or dry-lap pulp after the pulp has attained a moisture content of less than about 20% by weight.

Various operational aspects of the invention will now be discussed with reference to the drawings. FIG. 1 illustrates one embodiment of a method for treating relatively dry secondary or recycle fibers to increase the strength thereof wherein dry-bale pulp 2 is transported to a first conveyer 4 by a suitable transportation device 6. The conveyor transfers the pulp to a hammer mill 8 to further individualize the fibers before treatment.

Powdered agent 10 comprising a carboxylic acid anhydride from a source 12 is added with the dry-bale pulp on the conveyor 4 to the hammer mill 8 for treatment. The agent may be added by dusting it onto the pulp or by spraying it on in molten form or applying the agent to the pulp as a vapor or as a mixture with a substantially non-hydrolyzing medium or diluent such as clay, talc or the like.

The milled pulp/agent mixture 14 from hammer mill 8 is fed to a second conveyor 16 which transports the mixture 14 through a heater unit 18 for heating the mixture 14 to effect reaction between the pulp and the agent. In addition to or in lieu of mixing the agent with the pulp in the hammer mill 8, the agent 10 may be added to the pulp near the entrance 20 of heater unit 16. A quench spray 22 containing water or a dilute alkaline solution may be applied to the mixture 14 adjacent the exit 24 of the heater in order to cool the pulp and hydrolyze any excess agent. The treated pulp 26 may be conducted from unit 16 to a hydrapulper 28 for further processing according to conventional papermaking techniques.

Figure 2:
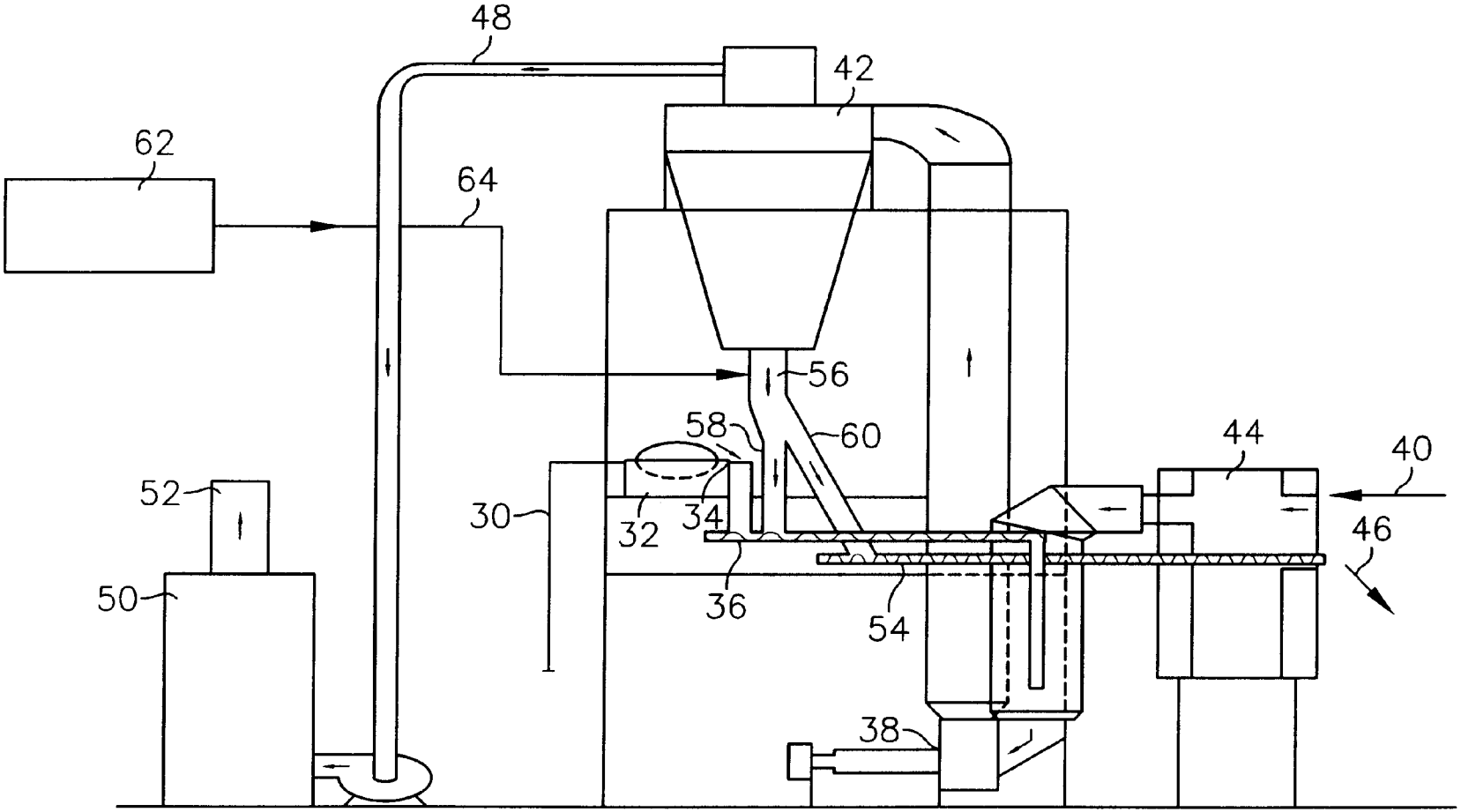
FIG. 2 is a schematic diagram of a method for increasing the bonding strength of pulp in a fluff pulp drying process.

FIG. 2 illustrates an embodiment of a treatment method according to the invention for increasing the strength of fluff pulp. Pulp in the form of an aqueous slurry is supplied via conduit 30 to a vacuum filter unit 32 for removal of water. The discharge filter cake 34 from the vacuum filter is then transported via screw conveyor 36 to a cage mill dryer 38 wherein it is contacted with a flow of hot gas 40 to heat, dry the pulp. As the filter cake 34 is contacted in the cage mill dryer 38, dust and fine fiber particles are formed. The hot gas used to dry the pulp in conveyor 36 enters the system through a dust chamber 44 which entrains and removes the fine particles from the dry pulp before discharging the pulp 46 from the system. The fine particles are entrained in the hot gas and transported with the hot gas through dryer 38 and out of dryer 38 to cyclone separator 42.

The dust and fine particles generated by dryer 38 are collected in cyclone separator 42 for recycle to the pulp. In the cyclone separator, relatively particulate free gas is conducted by conduit 48 to a gas scrubber 50 to remove any particles too fine to be removed in the cyclone separator before the gas is discharged to the atmosphere through exhaust port 52 of the scrubber 50. The larger particles separated from the gas stream by cyclone separator 42 are conveyed back into the filter cake 34 in screw conveyor 36 or screw conveyor 54 by means of conduits 56, 58 and 60.

The treatment agent from a source 62 may be sprayed as a molten liquid, added as a dry powder, or added as a vapor via conduit 64 to the relatively dry fiber particles exiting cyclone separator 42 in conduit 56, 58 and/or 60. In the alternative, the treatment agent may be added to the relative dry particles in conveyors 36 and/or 54. The mixture of relatively dry filter cake and solids in conveyor 36 is then fed to dryer 38 wherein the solids are reduced in size, fluffed and flash-dried by drying and conveying gas 40. At least a portion of the filter cake containing pulp and solids from separator 42 are directed by conveyor 54 through the dust chamber 44 before the treated pulp 46 is discharged from the system as a dry/treated pulp 46 which may be used in a conventional papermaking processes. After the pulp is treated with the agent, excess or unreacted agent may be removed from the treated pulp 46 by contacting the pulp with a water spray or quench spray (not shown).

Figure 3:
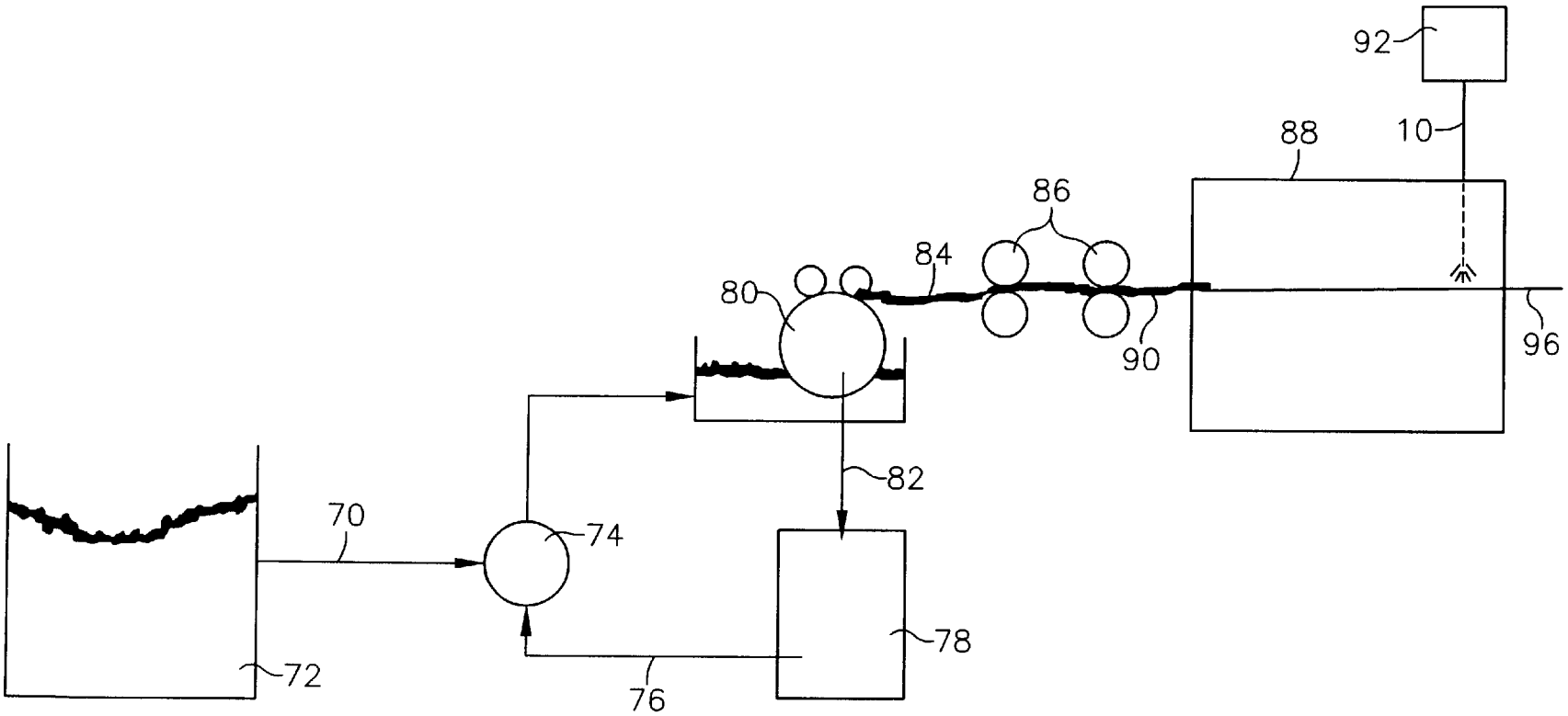
FIG. 3 is a schematic diagram of a method for increasing the bonding strength of pulp in a dry-lap pulp production process.

FIG. 3 illustrates a further embodiment of the invention where dry-lap pulp in conduit 70 from pulp chest 72 is conveyed to a fan pump 74 where it is mixed with white water delivered via conduit 76 from a seal vessel 78. The white water is supplied to seal vessel 78 from cylinder former 80 via conduit 82. Seal vessel 78 provides a liquid level of white water sufficient to maintain a vacuum on the cylinder former 80.

Fan pump 74 conveys the mixture of pulp and white water to the cylinder former 80 where a web 84 is formed from the pulp. The web 84 is conducted through a series of nip rolls 86 which squeeze water from the web having a moisture content of about 85% down to a moisture content of about 60% by weight and then the web is conducted to dryer unit 88 wherein the web is dried. Agent 10 in particulate or molten form is added to the pressed web 90 from source 92 at a point in the dryer 88 wherein the pressed web 90 has a moisture content of less than about 20% by weight. The web 90 containing the agent is heated in dryer 88 to bring about reaction between the agent and fiber surfaces to provide a cellulosic fibrous web 96 having increased strength.

If desired, web 96 may be treated to remove excess or unreacted agent prior to storage, sale or further processing. Such treatment may include, for example, spraying the web with a hydrolyzing agent and further drying the web or heating the web to a temperature sufficient to vaporize any excess agent.

The following nonlimiting examples illustrate various aspects of the invention. Unless otherwise indicated, temperatures are in degrees Celsius, percentages are by weight and percent of any pulp additive or moisture is based on the oven-dry weight of the pulp.

EXAMPLE 1

Texarkana softwood kraft pulp having a moisture content of about 5% by weight was passed through a hammer mill in order to separate the fibers into a loose mat of individualized fluff pulp. The fluff pulp was treated with 1% by weight maleic anhydride (MAH) powder by adding the MAH and tumbling the mixture to uniformly distribute the powder in the fluff pulp. The pulp samples were placed in foil and cured for 10 minutes at temperatures ranging from 20° to 140° C. After curing the pulp, the pH of the pulp was adjusted to 9 and the pulp was rinsed twice with distilled water. The carboxyl content in milliequivalents per gram (mEq/g) of the treated and untreated pulp samples was determined by the relationship (mL of HCl−2.14 mL of HCl)×0.05 mEq/mL HCl/mass of fibers in grams=carboxyl content. The surface charge of the pulp samples was determined by the adsorption of a cationic polymer by the pulp. Results are given in the following table and are shown graphically in FIG. 4.

TABLE 1

| Run No. | MAH (wt. %) | Curing Temp. (° C.) | Carboxyl Content (μEq/gram) | Surface Charge[1] (μEq/gram) | Surface Charge[1] (lb/ton) |
|---|---|---|---|---|---|
| 1 | 0 | 20 | 35 | 1.70 | 5.5 |
| 2 | 1 | 20 | 35 | 1.30 | 4.2 |
| 3 | 1 | 65 | 37 | 1.57 | 5.1 |
| 4 | 1 | 80 | 39 | 2.35 | 7.6 |
| 5 | 1 | 95 | 45 | 2.25 | 7.3 |
| 6 | 1 | 105 | 45 | 2.66 | 8.6 |
| 7 | 1 | 115 | 50 | 3.00 | 9.7 |
| 8 | 1 | 140 | 48 | 2.81 | 9.1 |

[1]Surface Charge determined by the adsorption of dry diallyldimethylammonium chloride (DADMAC) powder per weight of fiber by titrating the treated fiber with DADMAC polymer having a weight average molecular weight of about 375,000 grams per mole sold under the tradename BUFLOC 536 which is commercially available from Buckman Laboratories, Inc. of Memphis, Tennessee. The titration endpoint was identified with the point of zero streaming potentialafter mixing the DADMAC with the pulp for 1 to 5 minutes.

This data shows that as the curing temperature is increased above 20° C., the carboxyl content and surface charge increase up to a maximum at a curing temperature of 115° C. A curing temperatures as high as 140° C., while providing a significant increase in the carboxyl content over the untreated fiber, did not provide a significant increase relative to a curing temperature of 115° C. for increasing the carboxyl content and surface charge of the fiber. The data also indicates that the surface charge as determined by the adsorption of DDMAC cationic polymer was almost double that of the untreated fiber at a curing temperature of 115° C., and that the surface charge increased by a greater relative amount than the carboxyl content of the pulp (170% versus 140%).

Figure 4:
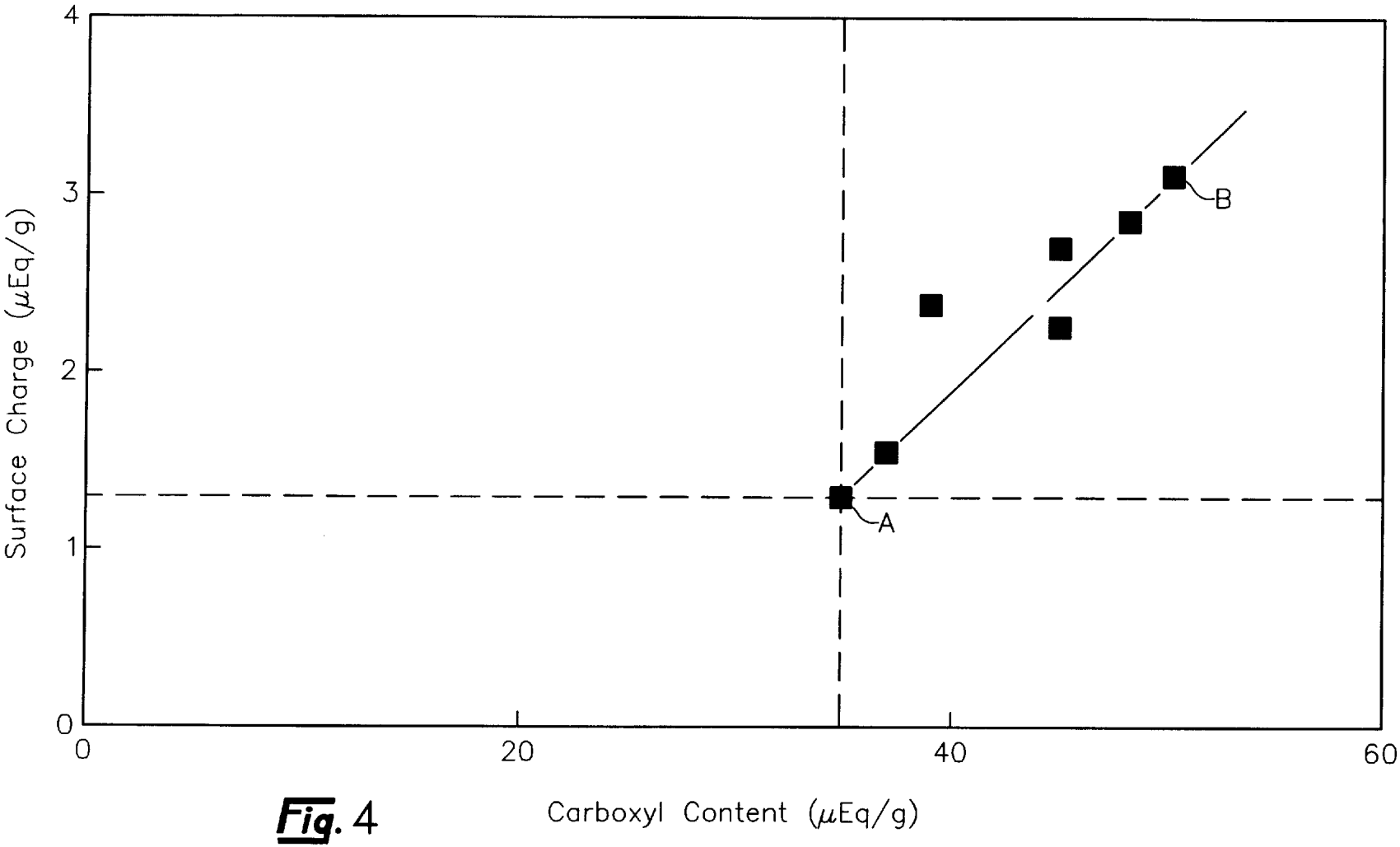
FIGS. 4, 5 and 6 are graphical representations of effects a strength agent has on the carboxyl content and surface charge of pulp at various curing temperatures.

As illustrated in FIG. 4, the untreated pulp represented by point A had a carboxyl content of 35 μEq/gram and a surface charge of 1.7 μEq/gram whereas the treated pulp had a carboxyl content ranging from 35 to 50 for a surface charges ranging from 1.3 μEq/gram to a maximum at point B of 3.0 μEq/gram.

Circular handsheets containing the treated and control pulp samples were prepared according to TAPPI method T205, and the properties of the handsheets were determined. The results are given in the following table.

TABLE 2

| Run No. | MAH (wt. %) | Curing Temp. (° C.) | Basis weight (gram/m$^2$) | Scott Bond (E-3 ft-lbf) | Normalized Tensile (lbf/in) | Normalized Gurley Densometer (sec/100 cc) |
|---|---|---|---|---|---|---|
| 1 | 0 | 20 | 106.0 | 30.0 | 8.15 | 0.57 |
| 2 | 1 | 20 | 104.8 | 31.0 | 8.13 | 0.47 |
| 3 | 1 | 65 | 102.0 | 30.0 | 8.44 | 0.43 |
| 4 | 1 | 80 | 105.5 | 29.6 | 7.70 | 0.42 |
| 5 | 1 | 95 | 104.3 | 39.2 | 8.04 | 0.45 |
| 6 | 1 | 105 | 106.3 | 32.2 | 8.66 | 0.44 |
| 7 | 1 | 115 | 106.0 | 37.0 | 7.27 | 0.38 |
| 8 | 1 | 140 | 106.3 | 28.8 | 6.62 | 0.35 |

The results show that the internal bond strength was maximized after curing the samples for 10 minutes at a temperature in the range of 90° to 120° C.. At 140° C. the bond strength decreased to below the level of the untreated sample. Thus, above 120° C., the tensile strength of the samples decreased.

Figure 5:
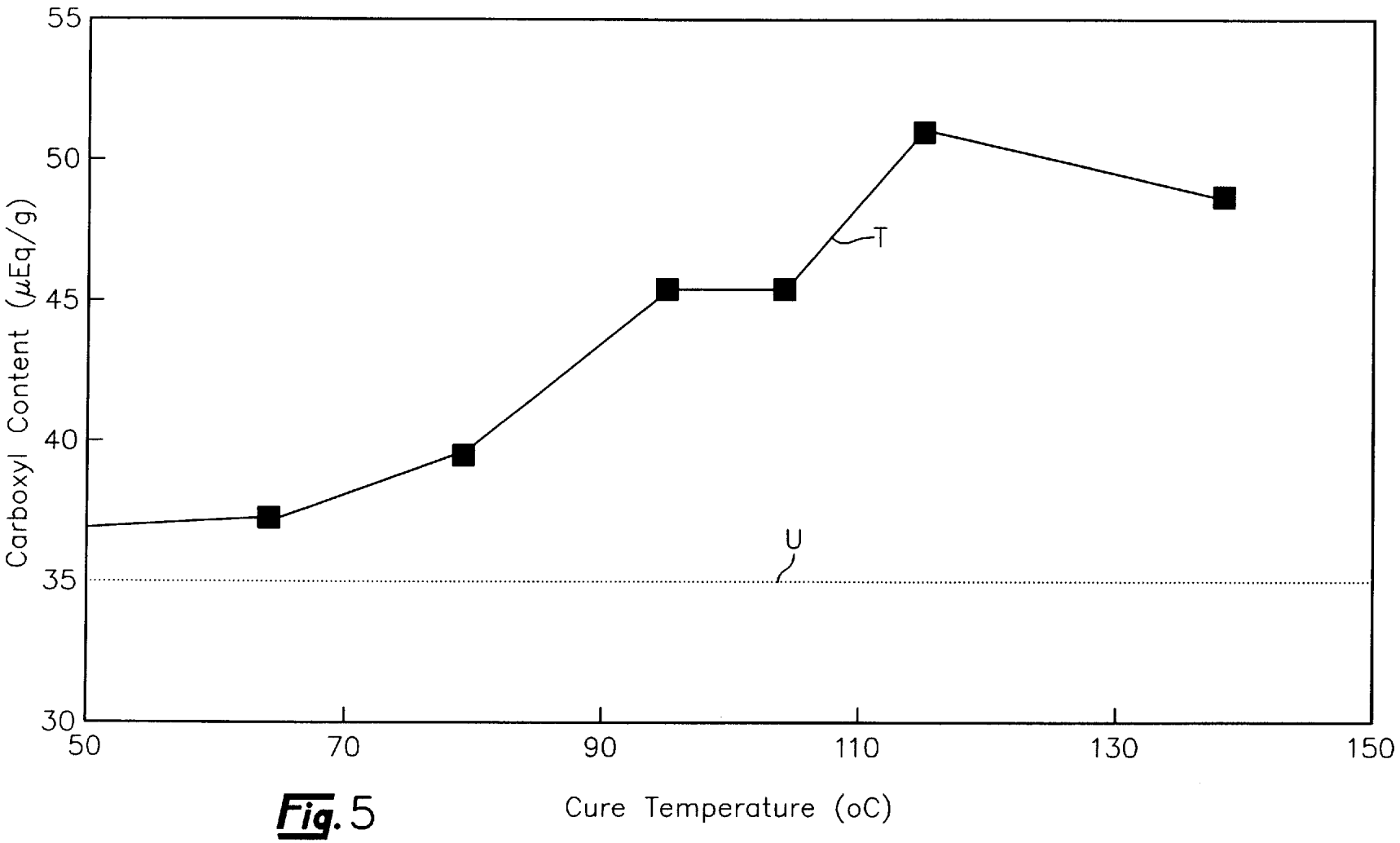
Figure 6:
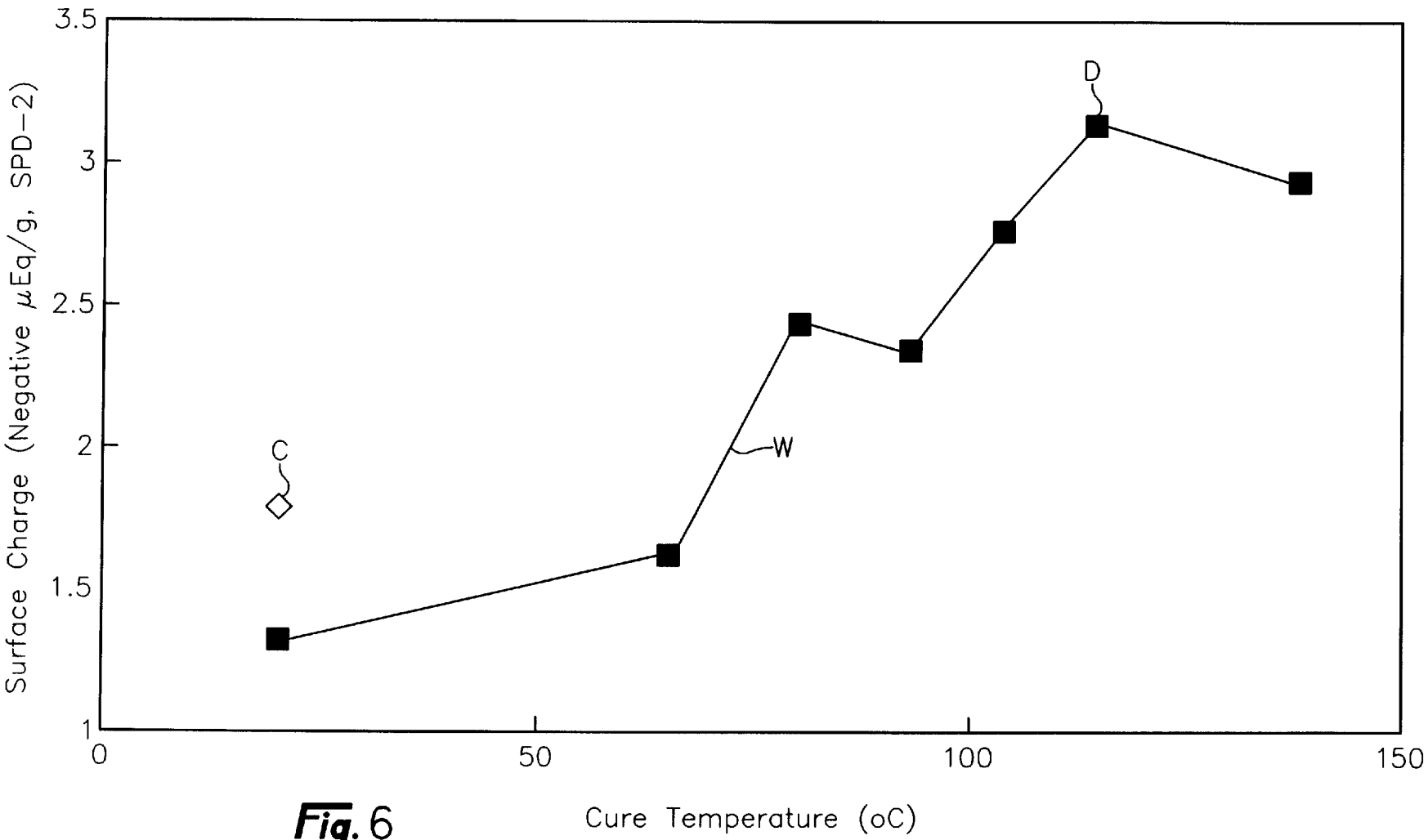

The results of Table 2 are illustrated graphically in FIG. 5 and 6. In FIG. 5, curve U represents the carboxyl content of the untreated pulp versus temperature whereas curve T represents the variation in carboxyl content with curing temperature of pulp treated with 1% by weight maleic anhydride. In FIG. 6, point C represents the surface charge of untreated pulp and the points on curve W represent the surface charges of the maleic anhydride treated pulp at various curing temperatures. A maximum surface charge of 3 $\mu$Eq/gram was obtained at 115° C. as represented by point D on curve W.

The maximum strength properties of the samples cured at intermediate temperatures was consistent with the effects of heating on the porosity of paper made from the samples. An increase in porosity or decrease in Gurley Densometer value was more evident when the samples were cured at 120° C. and above which reflects the relatively poor bonding achieved under such conditions. It is believed that the maximum tensile strength at about 100° C. represents the optimum curing conditions for the samples.

EXAMPLE 2

In the following runs, pulp samples of Texarkana softwood kraft pulp were treated with maleic anhydride powder in amounts ranging from 0 to 1% by weight. The moisture content of the samples was varied between 5 and 50% by weight. The samples were placed in foil and cured for 5 minutes at 100° C.. Circular handsheets containing the treated and untreated pulp samples were prepared according to TAPPI method T205. Results are given in the following table.

TABLE 3

| Run No. | MAH (wt. %) | Moisture (wt. %) | Surface Charge ($\mu$Eq/gram) | Breaking Length (m) | Scott Bond (E-3 ft-lbf) |
|---|---|---|---|---|---|
| 1 | 0 | 5 | 0.58 | 1,576 | 26.2 |
| 2 | 0.1 | 5 | 0.49 | 1,020 | 18.4 |
| 3 | 0.3 | 5 | 0.71 | 1,159 | 18.8 |
| 4 | 1 | 5 | 1.19 | 1,250 | 28.2 |
| 5 | 1 | 20 | 0.45 | 895 | 16.4 |
| 6 | 1 | 50 | 0.45 | 848 | 18.4 |

As can be seen from the data, the surface charge density generally increased as the amount of maleic anhydride used to treat the pulp increased. Also, the higher moisture content samples exhibited a dramatic decrease in the surface charge, breaking length and internal bond over the samples treated with the same amount of maleic anhydride at a moisture content of only about 5% by weight.

EXAMPLE 3

Dry-baled bleached softwood kraft fibers were milled and fluffed in a hammer mill. Half of the fluffed fibers were retained as a "control" sample. The fluffed fibers were mixed with 1 percent by weight maleic anhydride powder based on the oven-dry weight of solids. The samples were each sealed in aluminum foil and heated at a temperature of 108° C. for 10 minutes. The samples were then redispersed in water, providing 1000 mL each of 2 weight percent solids suspension. Sufficient dilute NaOH was added to each slurry to raise the pH to 10. Each sample was then rinsed twice with distilled water using a Buchner funnel to rinse and dewater the pulp. The pulp samples were then re-slurried to 1000 mL in distilled water.

The density of carboxyl groups in each sample of suspended pulp was determined by titrating the samples with 0.05 N HCl to a pH of 3.0. In each case, the initial pH of the pulp suspension was adjusted to 8.0 before titration. Results are given in the following table.

TABLE 4

| Sample Description | Fiber mass (grams) | Volume of 0.05 N HCl (mL) | Carboxyl Content (mEq/g) |
|---|---|---|---|
| distilled water | 0.00 | 2.14 | 0.00 |
| control | 0.814 | 3.25 | 0.068 |
| treated pulp | 0.911 | 8.30 | 0.34 |

Circular handsheets of the treated pulp and control were prepared according to TAPPI method T205 with levels of cationic potato starch equal to zero, 20 and 40 pounds per ton of pulp. Physical tests of the handsheets were conducted to determine breaking length, Scott internal bond, Gurley stiffness, apparent density and Z-directional tensile strength of the resulting paper. The results are given in Table 5.

TABLE 5

| Sample | Breaking Length (meters) (TAPPI T-494) | Percent Stretch (TAPPI T-494) | Scott Internal Bond (TAPPI 403) | Z-Directional Tensile (TAPPI T-541) | Gurley Stiffness (TAPPI T-543) | Apparent Density (g/cm$^3$) (TAPPI T-220) |
|---|---|---|---|---|---|---|
| | | | Control | | | |
| starch (0 lbs/ton) | 1445 | 1.42 | 31.4 | 26.2 | 124.3 | 0.52 |
| starch (20 lbs/ton) | 2288 | 2.60 | 61.2 | 60.2 | 100.9 | 0.52 |
| starch (40 lbs/ton) | 2231 | 2.59 | 57.8 | 60.5 | 62.3 | 0.52 |
| | | | Treated pulp | | | |
| starch (0 lbs/ton) | 2838 | 2.59 | 75.6 | 55.6 | 63.5 | 0.49 |
| starch (20 lbs/ton) | 3592 | 2.74 | 85.0 | 62.5 | 179.1 | 0.50 |
| starch (40 lbs/ton) | 3714 | 2.81 | 99.8 | 88.6 | 163.7 | 0.57 |

These results show a substantial increase in the density of carboxyl groups in pulp fibers treated according to the invention compared to the untreated fibers. Treatment of pulp fibers according to the invention increased the breaking length by a factor of 2.0 and the Scott internal bond by a factor of 2.4. The addition of 20 lbs/ton cationic starch yielded an additional increase in breaking length to 3592 meters. No further benefit in breaking length was evident by increasing the starch level from 20 lbs/ton to 40 lbs/ton.

The results also show that the vastly improved strength properties achieved using the invention enable even greater improvement in the effect of adding starch. The tests conducted using treatment with the agent of the invention and starch show substantially better properties over use of starch alone.

EXAMPLE 4

In this example, samples of treated pulp were prepared from shredded office paper. The office paper included 50 wt.% xerographic paper prepared under alkaline papermaking conditions and 50 wt.% computer form bond paper prepared under acidic papermaking conditions. The mixture therefore represented a cross-section of office-type papers which are conventionally available for recycling.

The mixture of recycled paper was shredded into quarter-inch strips and pre-dried for 20 minutes at 105° C.. Three 40 gram samples of dry shredded strips were placed in aluminum foil bags. Sample 1 was mixed with 0.8 grams of maleic anhydride powder. Sample 2 was mixed with 0.8 grams of maleic acid powder. Sample 3 contained only shredded paper with no treatment chemicals. In each case, the sealed bags were shaken for 30 seconds to thoroughly mix the powders with the shredded paper. After mixing, the foil bags were placed side-by-side on a shelf in a convection oven for 15 minutes at 95° C.

The treated paper samples (1 and 2) were dispersed in 2 liters of tap water using a disintegrator according to TAPPI Method T205 using 50,000 revolutions in each case. The final pH was 7.5 for samples 1 and 2 and 9.0 for sample 3. Handsheets were prepared from the samples according to test Method T205 with the exception that drying of the hand sheets was conducted on a polished chrome surface heated to 105° C. with the sheets held on the surface with a fabric. The physical properties of the prepare handsheets are given in the following table.

TABLE 6

| Sample No. | Treatment Chemical | Internal Bond ($10^{-3}$ ft.-lbf) | Breaking length (km) |
|---|---|---|---|
| 1 | maleic anhydride | 106 | 4.15 |
| 2 | maleic acid | 87 | 3.87 |
| 3 | control | 93.6 | 4.07 |

As shown in the foregoing table, the handsheets made from shredded paper treated with maleic anhydride (Sample 1) had significantly greater internal bond strength and breaking length than the untreated sample (Sample 3) and the sample treated with maleic acid (Sample 2). The sample treated with maleic acid had significantly lower bond strength and breaking length than the untreated and maleic anhydride treated samples.

Additional data was obtained for the same treated and untreated paper samples using a lesser degree of disintegration to disperse the samples (15,000 revolutions). In this case, handsheets were prepared with the further addition of 0,20 or 40 pounds per ton of cationic potato starch available from Cytec Technology Corporation of Wilmington, Del. under the trade name ACCOSIZE 72. The results are given in the following table.

TABLE 7

| | | Internal Bond Strength ($10^{-3}$ ft.-lbf) | | |
|---|---|---|---|---|
| Sample No. | Treatment Chemical | 0 lb/ton starch | 20 lb/ton starch | 40 lb/ton starch |
| 1 | maleic anhydride | 144.8 | 165.8 | 195.6 |
| 2 | maleic acid | 133.2 | 154.4 | 152.0 |
| 3 | control | 136.6 | 153.6 | 152.4 |

As shown by the foregoing samples, there was a synergistic increase in bonding strength when a cationic starch was used with maleic anhydride to treat the samples. For the acid treated and untreated samples, the starch increased the bonding strength only about $17\times10^{-3}$ ft.-lbf over the untreated control sample at both 20 and 40 lb/ton of starch. Maleic anhydride treatment alone increased the bonding strength about $8\times10^{-3}$ ft.-lbf over the untreated control sample. However, at 20 lb/ton of starch, the bonding strength of the maleic anhydride treated sample increased $29\times10^{-3}$ ft.-lbf over the untreated control sample and increased $59\times10^{-3}$ ft.-lbf over the untreated control sample at 40 lb/ton of starch. These results were unexpected and clearly indicate the advantage of treating recycled pulp with maleic anhydride.

EXAMPLE 5

In order to compare the effect of treating paper with maleic anhydride as a powder and by means of a solution of maleic anhydride, 1% and 5% by weight maleic anhydride powder was added to blotter paper samples 2 and 3 respectively. Blotter paper was also dipped in solutions of maleic anhydride in acetone (samples 4 and 5) so that the total amount of maleic added to each sample was the same as in samples 2 and 3. Sample 1 was a control sample which was not treated. The samples made using the acetone solution of maleic anhydride were air-dried at room temperature. All of the samples were cured on a rotating cylinder at 110° C. for 60 seconds.

In order to determine the carboxyl content of the samples, the samples were hydrolyzed in distilled water, the impurities were extracted with dilute hydrochloric acid and the samples were thoroughly washed. The washed samples were then reacted with calcium acetate to liberate acetic acid and the acetic acid was titrated with HCl to provide the carboxyl content of the pulp. The results of the treatment are given in the following table.

TABLE 8

| Sample No. | Treatment | Maleic anhydride (wt. %) | Carboxyl content ($\mu$Eq/gram) | Scott Bond ($10^{-3}$ ft.-lbf) |
|---|---|---|---|---|
| 1 | none | 0 | 4.16 | 26.2 |
| 2 | dry powder | 1 | 5.40 | 15.4 |
| 3 | dry powder | 5 | 9.12 | 14.2 |
| 4 | acetone solution | 1 | 4.84 | 20.8 |
| 5 | acetone solution | 5 | 6.73 | 22.0 |

As shown by the foregoing samples, paper samples treated with powdered maleic anhydride (samples 2 and 3) had a significant increase in the carboxyl content compared to untreated samples and compared to samples treated with same amount of maleic anhydride from an acetone solution. In all of the maleic anhydride treated samples, the internal bond strength was reduced which indicated that the curing conditions were beyond the optimum time and temperature for effective treatment with maleic anhydride.

Having now described various aspects of the invention and preferred embodiments thereof, it will be recognized by those of ordinary skill that numerous modifications, variations and substitutions may exist within the spirit and scope of the appended claims.

What is claimed is:

1. A method for treating cellulosic fibers to improve the strength of the fibers which comprises contacting cellulosic fibers having a moisture content of about 20% or less with from about 0.01 to about 10 percent based on oven-dried weight of fibers of an agent in particulate form, non-hydrolyzed liquid form or vapor form comprising a carboxylic acid cyclic anhydride and heating the fibers and agent contacted therewith at a temperature ranging from about 50° to about 120° C. and for a time sufficient to substantially increase the bonding strength of the fibers.

2. The method of claim 1 further comprising preparing a pulp slurry containing the treated fibers and dewatering the slurry on a papermaking machine to provide a fibrous web containing the treated fibers.

3. The method of claim 1 wherein the agent comprises a dicarboxylic acid anhydride.

4. The method of claim 1 wherein the agent is in powder form.

5. The method of claim 1 wherein the agent is provided as a molten liquid.

6. The method of claim 1 wherein the agent is provided as a vapor obtained by heating the agent above about 50° C.

7. The method of claim 1 wherein the agent comprises maleic anhydride in powder form.

8. The method of claim 1 wherein the agent comprises maleic anhydride provided as a molten liquid.

9. The method of claim 1 wherein the fiber and agent contacted therewith are heated in a dryer.

10. The method of claim 1 wherein the fibers have a moisture content of less than about 20% by weight based on oven-dried weight of fibers.

11. The method of claim 1 wherein the agent is supplied in particulate form as a dissolved component of a non-hydrolyzing solvent solution which is evaporated prior to or during the heating leaving the anhydride in contact with the fibers.

12. The method of claim 11 wherein the anhydride comprises maleic anhydride.

13. A method for treating cellulosic fibers having a moisture content of about 20% or less by weight based on the oven dry weight of the fiber which comprises applying to the fibers an agent in particulate form, non-hydrolyzed liquid form or vapor form in an amount ranging from about 0.01 to about 10 percent based on oven-dried weight of fibers and thereafter heating the fibers at a temperature ranging from about 50° to about 120° C. and for a time sufficient to substantially increase the strength of the fibers and then contacting the fibers with a dilute basic solution followed by rinsing with water, wherein the agent comprises a carboxylic acid cyclic anhydride.

14. The method of claim 13 wherein the agent comprises a dicarboxylic acid anhydride in powder form.

15. The method of claim 13 wherein the agent comprises maleic anhydride in powder form.

16. The method of claim 13 wherein the agent comprises maleic anhydride provided as a molten liquid.

17. The method of claim 13 wherein the agent comprises maleic anhydride provided as vapor obtained by heating the maleic anhydride above about 50° C.

18. The method of claim 13 further comprising slurrying the treated fibers in water to make a papermaking furnish and then dewatering and drying the fibers on a papermaking machine.

19. The method of claim 13 wherein the agent is supplied in particulate form as a dissolved component of a non-hydrolyzing solvent solution which is evaporated prior to or during the heating leaving the anhydride in contact with the fibers.

20. The method of claim 19 wherein the anhydride comprises maleic anhydride.

21. A method for treating cellulosic fibers to increase their strength which comprises mixing cellulosic fibers having a moisture content at or below about 20% by weight based on the oven dry weight of the fibers with from about 0.01 to about 10 percent particulate maleic anhydride based on oven-dried weight of fibers and heating the mixture at a temperature ranging from about 50° to about 120° C. which temperature is sufficient to significantly increase the carboxyl content of the fibers without significantly embrittling the fibers.

22. The method of claim 21 wherein the maleic anhydride is in powder form.

23. The method of claim 21 wherein the particulate maleic anhydride is mixed with the fibers by spraying a liquid containing the maleic anhydride onto the fibers.

* * * * *